US010847902B2

(12) United States Patent
Kurk et al.

(10) Patent No.: US 10,847,902 B2
(45) Date of Patent: Nov. 24, 2020

(54) ENHANCED PHASE SHIFTER CIRCUIT TO REDUCE RF CABLES

(71) Applicant: CommScope Technologies LLC, Hickory, NC (US)

(72) Inventors: Morgan C. Kurk, Sachse, TX (US); Martin L. Zimmerman, Chicago, IL (US)

(73) Assignee: CommScope Technologies LLC, Hickory, NC (US)

( * ) Notice: Subject to any disclaimer, the term of this patent is extended or adjusted under 35 U.S.C. 154(b) by 10 days.

(21) Appl. No.: 16/178,633

(22) Filed: Nov. 2, 2018

(65) Prior Publication Data

US 2019/0074602 A1 Mar. 7, 2019

Related U.S. Application Data

(60) Continuation of application No. 15/244,300, filed on Aug. 23, 2016, now Pat. No. 10,148,017, which is a (Continued)

(51) Int. Cl.
*H01Q 21/30* (2006.01)
*H01P 1/18* (2006.01)

(Continued)

(52) U.S. Cl.
CPC ..... *H01Q 21/30* (2013.01); *H01P 1/184* (2013.01); *H01Q 1/241* (2013.01); *H01Q 1/246* (2013.01);

(Continued)

(58) Field of Classification Search
CPC ..... H01Q 1/241; H01Q 1/26; H01Q 21/30; H01Q 1/24; H01Q 1/246; H01P 1/184
See application file for complete search history.

(56) References Cited

U.S. PATENT DOCUMENTS 4,689,627 A 8/1987 Lee et al.
5,982,252 A * 11/1999 Werlau ..... H01P 5/16 333/127

(Continued)

FOREIGN PATENT DOCUMENTS

CN 101587989 A 11/2009
CN 102347529 A 2/2012

(Continued)

OTHER PUBLICATIONS

Office Action from corresponding European Patent Application No. 14802746.9, dated Jun. 26, 2018.

(Continued)

*Primary Examiner* — Hoang V Nguyen
(74) *Attorney, Agent, or Firm* — Myers Bigel, P.A.

(57) ABSTRACT

A multi-band antenna system includes an array of wide-band radiating elements and a multi-band electrical tilt circuit. The multi-band electrical tilt circuit includes a plurality of combiners, a first RF band variable phase shifter and a second RF band variable phase shifter implemented in a common medium. The common medium may comprise a PCB, a stripline circuit, or the like. Each combiner includes a combined port, a first RF band port, and a second RF band port. The combined ports are coupled to the radiating elements. The first RF band phase shifter has a first plurality of variably phase shifted ports connected to the first RF band ports of the combiners via transmission line, and the second RF band phase shifter has a second plurality of variably phase-shifted ports connected to the second RF band ports of the combiners via transmission line. The phase shifters are independently configurable.

20 Claims, 6 Drawing Sheets

Related U.S. Application Data division of application No. 14/274,321, filed on May 9, 2014, now Pat. No. 9,444,151.

(60) Provisional application No. 61/925,903, filed on Jan. 10, 2014.

(51) Int. Cl.

| | |
|---|---|
| ***H01Q 1/24*** | (2006.01) |
| ***H01Q 3/36*** | (2006.01) |
| ***H01Q 5/20*** | (2015.01) |
| ***H01Q 5/28*** | (2015.01) |
| ***H01Q 5/50*** | (2015.01) |
| ***H01Q 1/38*** | (2006.01) |
| *H01P 1/213* | (2006.01) |

(52) U.S. Cl.

CPC ..... *H01Q 1/38* (2013.01); *H01Q 3/36* (2013.01); *H01Q 5/20* (2015.01); *H01Q 5/28* (2015.01); *H01Q 5/50* (2015.01); *H01P 1/2135* (2013.01)

(56) References Cited

U.S. PATENT DOCUMENTS

| | | | | |
|---|---|---|---|---|
| 6,067,053 | A | 5/2000 | Runyon et al. | |
| 6,384,680 | B1 | 5/2002 | Takei et al. | |
| 7,170,466 | B2 | 1/2007 | Janoschka | |
| 2002/0053954 | A1* | 5/2002 | Shamsaifar | H01P 1/213 333/135 |
| 2005/0046514 | A1 | 3/2005 | Janoschka | |
| 2012/0113874 | A1* | 5/2012 | Sanguinetti | H04B 1/525 370/277 |

FOREIGN PATENT DOCUMENTS

| | | |
|---|---|---|
| CN | 103107387 | 5/2013 |
| EP | 2629358 A2 | 8/2013 |
| GB | 2410838 | 8/2005 |
| WO | 2012/016941 A1 | 2/2012 |
| WO | 2012/048343 A1 | 4/2012 |

OTHER PUBLICATIONS

Notification Concerning Transmittal of International Preliminary Report on Patentability, PCT/US2014/063882, Jul. 21, 2016, 8 pages.

International Search Report regarding related International Application PCT/US2014/063882, dated Feb. 9, 2015 (5 pages).

Written Opinion of the International Searching Authority regarding related International Application PCT/US2014/063882, dated Feb. 9, 2015 (9 pages).

Communication pursuant to Article 94(3) EPC corresponding to European Patent Application No. 14802746.9 (dated Sep. 18, 2017) (9 pages).

Office Action from corresponding Chinese Application No. 201480071320.4, dated May 15, 2019, 9 pages.

* cited by examiner

ENHANCED PHASE SHIFTER CIRCUIT TO REDUCE RF CABLES

CROSS-REFERENCE TO RELATED APPLICATIONS

This application claims priority under 35 U.S.C. § 120 as a continuation of U.S. patent application Ser. No. 15/244,300, filed Aug. 23, 2016, which, in turn, claims priority as a divisional of Ser. No. 14/274,321, filed May 9, 2014, which claims priority under 35 U.S.C. § 119 from U.S. Provisional Patent Application Ser. No. 61/925,903, filed Jan. 10, 2014, the entire content of each of which is incorporated herein by reference in its entirety.

BACKGROUND

The present invention relates generally to wireless communications antennas. In particular, the invention relates to an improved feed network for using an array of radiating elements for more than one band of communications frequencies.

Dual band antennas for wireless voice and data communications are known. For example, common frequency bands for GSM services include GSM900 and GSM1800. GSM900 operates at 880-960 MHz. GSM1800 operates in the frequency range of 1710-1880 MHz. Antennas for communications in these bands of frequencies typically include an array of radiating elements connected by a feed network. For efficient transmission and reception of Radio Frequency (RF) signals, the dimensions of radiating elements are typically matched to the wavelength of the intended band of operation. Because the wavelength of the 900 MHz band is longer than the wavelength of the 1800 MHz band, the radiating elements for one band are typically not used for the other band. In this regard, dual band antennas have been developed which include different radiating elements for the two bands. See, for example, U.S. Pat. Nos. 6,295,028, 6,333,720, 7,238,101 and 7,405,710 the disclosures of which are incorporated by reference.

In some dual band systems, wide band radiating elements are being developed. In such systems, there are at least two arrays of radiating elements, including one or more arrays of low band elements for low bands of operating frequencies (e.g., GSM900 and/or Digital Dividend at 790-862 MHz), and one or more arrays of high band radiating elements for high bands of operating frequencies (e.g., GSM1800 and/or UTMS at 1920 MHz-2170 MHz).

Known dual band antennas, while useful, may not be sufficient to accommodate future traffic demands Wireless data traffic is growing dramatically in various global markets. There are growing number of data service subscribers and increased traffic per subscriber. This is due, at least in part, to the growing popularity of "smart phones," such as the iPhone, Android-based devices, and wireless modems. The increasing demand of wireless data is exceeding the capacity of the traditional two-band wireless communications networks. Accordingly, there are additional bands of frequencies which are being used for wireless communications. For example, LTE2.6 operates at 2.5-2.7 GHz and WiMax operates at 3.4-3.8 GHz.

One solution is to add additional antennas to a tower to operate at the LTE and higher frequencies. However, simply adding antennas poses issues with tower loading and site permitting/zoning regulations. Another solution is to provide a multiband antenna that includes at least one array of radiating elements for each frequency band. See, for example, U.S. Pat. Pub. No. 2012/0280878, the disclosure of which is incorporated by reference. However, multiband antennas may result an increase in antenna width to accommodate an increasing number of arrays of radiating elements. A wider antenna may not fit in an existing location or, if it may physically be mounted to an existing tower, the tower may not have been designed to accommodate the extra wind loading of a wider antenna. The replacement of a tower structure is an expense that cellular communications network operators would prefer to avoid when upgrading from a single band antenna to a dual band antenna. Also, zoning regulations can prevent of using bigger antennas in some areas.

Another attempted solution may be found in Application No. PCT EP2011/063191 to Hofmann, et al. Hofmann suggests using diplexers to combine a LTE frequency band at 2.6 GHz, with a SCDMA frequency band at 1.9-2.0 GHz, and applying both bands to a common radiating element. This helps reduce antenna width, but at a cost of increasing the number of coaxial transmission lines in the antenna. In the example of FIG. 2 of Hofmann, eight dual polarized radiating elements are illustrated per column. For each column, there would be eight LTE coaxial lines and eight SCDMA coaxial lines, for each of two polarizations, yielding a total of 32 coaxial lines per column. Given that there are four columns illustrated, the solution of Hofmann would require 128 coaxial lines just between the phase shifters and the diplexers.

SUMMARY

A multi-band antenna system may include an array of wide-band radiating elements and a multi-band electrical tilt circuit. The multi-band electrical tilt circuit may include a plurality of combiners, a first RF band variable phase shifter and a second RF band variable phase shifter implemented in a common medium. The common medium may comprise a PCB, a stripline circuit, or the like. Each combiner of the plurality of combiners may include a combined port, a first RF band port, and a second RF band port. The combined ports of the combiners are coupled to the array of wide-band radiating elements. The first RF band variable phase shifter has a first plurality of variably phase shifted ports connected to the first RF band ports of the plurality of combiners via transmission line, and the second RF band variable phase shifter has a second plurality of variably phase-shifted ports connected to the second RF band ports of the plurality of combiners via transmission line. The first RF band variable phase shifter is configurable independently from the second RF band variable phase shifter.

When the common medium comprises a single printed circuit board, the plurality of combiners, at least a fixed portion of the first RF band phase shifter and at least a fixed portion of the second RF band phase shifter are fabricated as part of the single printed circuit board.

The multi-band electrical tilt circuit may further comprise a third band, fourth band, or more bands, by including a corresponding number of additional band phase shifters and additional ports on the combiners. The number of combiners may equal a number of wide-band radiating elements. The combiners may be implemented using stepped impedance microstrip on PCB. The combiners may comprise diplexers and/or duplexers.

The multi-band antenna system of claim 1 may be implemented as a dual polarized antenna system. In this example, the wide-band radiating elements comprise dual-polarized wide-band radiating elements and the multi-band electrical tilt circuit comprises a first polarization multi-band electrical tilt circuit, coupled to a first polarization element of the dual polarized wide band radiating elements, the multi-band antenna system further comprising a second polarization multi-band electrical tilt circuit coupled to a second polarization element of the dual polarized wide-band radiating elements. In another dual polarized example, there may be a first multi-band electrical tilt circuit implemented in a common medium coupled to first polarization feeds of the dual polarized wideband radiating elements, and a second multi-band electrical tilt circuit implemented in another common medium coupled to second polarization feeds of the dual polarized wideband radiating elements.

DETAILED DESCRIPTION

Figure 1:
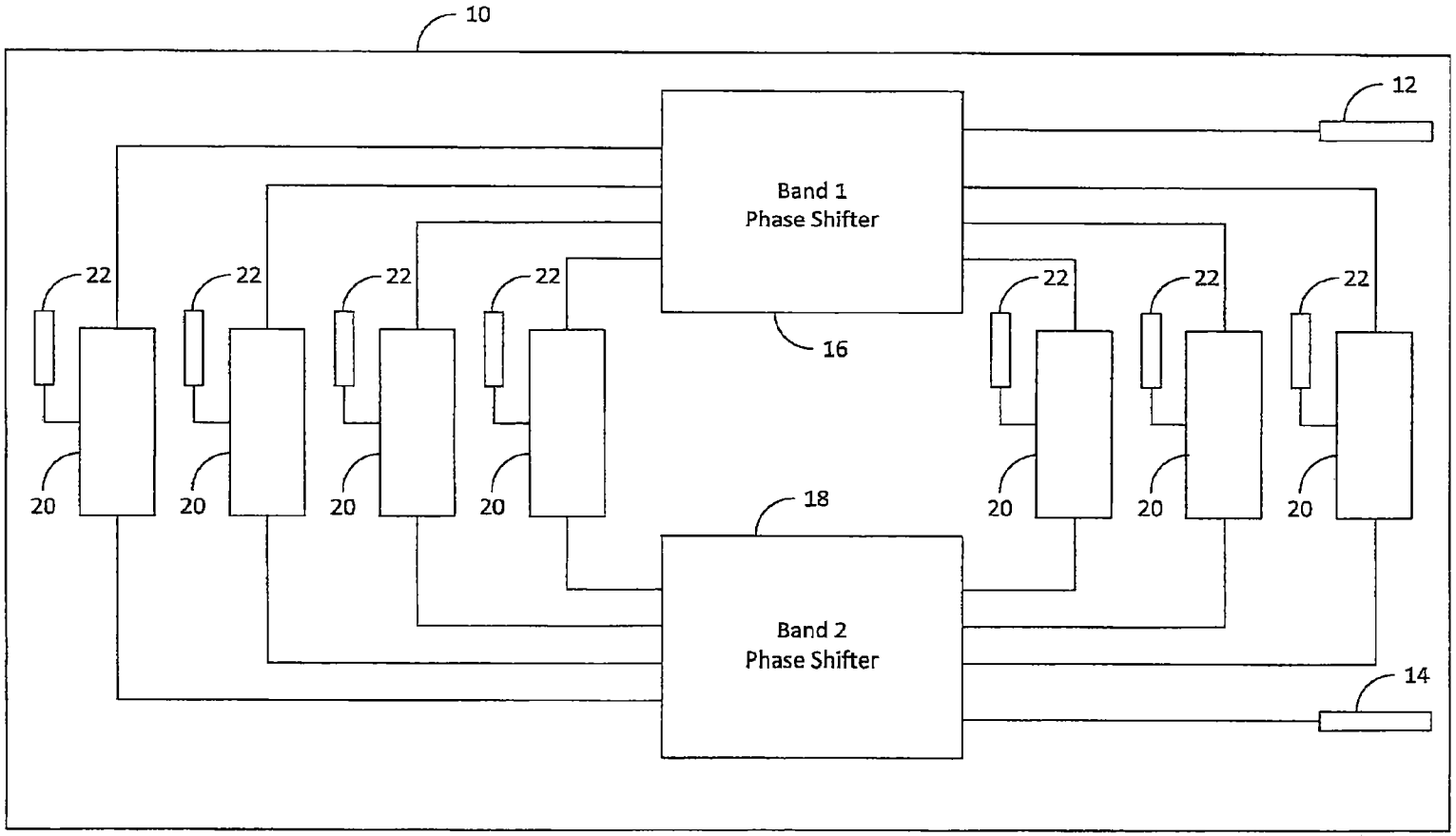
FIG. 1 is a schematic view of a dual band electric tilt circuit board according to one example of the invention.

A multi-band electrical tilt circuit board 10 is illustrated in schematic form in FIG. 1. As used herein, "multi-band" refers to two or more bands. The multi-band electrical tilt circuit board 10 includes a transmission line termination 12 for a first RF band, a transmission line termination 14 for a second RF band, a first RF band variable phase shifter 16, and a second RF band variable phase shifter 18. The transmission line termination 12 is for terminating a transmission line, such as a coaxial cable, from a radio operating in the first RF band, and transmission line termination 14 is for terminating a transmission line from a radio operating in the second RF band. There may also be transmission line terminations on the back or bottom of the antenna system, with an intermediate cable between the termination and the multi-band electrical tilt circuit band 10. The transmission line terminations 12, 14 may comprise solder pads or a capacitive coupling. This multi-band electrical tilt circuit board 10 may be suitable for an antenna having a single polarization. In another example, two multi-band electrical tilt circuit boards 10 are employed, one for each polarization of a dual-polarized antenna.

The phase shifters 16, 18, may comprise variable differential, arcuate phase shifters as illustrated in U.S. Pat. No. 7,907,096, which is incorporated by reference. In such variable phase shifters, a rotatable wiper arm variably couples an RF signal to a fixed arcuate transmission line. In the illustrated example, the phase shifters perform a 1:7 power division (which may or may not be tapered) in the direction of radio transmission, and a 7:1 combination in the direction of radio reception. One of ordinary skill in the art will readily recognize that other types of phase shifters, such as phase shifters having greater or fewer ports, may be used without departing from the scope and spirit of the invention. Herein, the terms "input" and "output" refer to the direction of RF signals when transmitting from a base station radio to the radiating elements of an antenna. However, the devices herein also operate in the receive direction, and the terms "input" and "output" would be reversed if considering RF signal flow from radiating elements to the base station radios. Taking the example of the first RF band variable phase shifter, an input is coupled to transmission line termination 12. The phase shifter has seven output ports, six of which are differentially variably phase shifted. There is also one output which maintains a fixed phase shift, however, an output having a fixed phase relationship to the input is optional.

The seven outputs of the phase shifters 16, 18 are individually coupled to seven combiners 20. Each combiner 20 has three ports: 1) a first RF band port coupled to an output of phase shifter 16; 2) a second RF band port coupled to an output of phase shifter 18; and 3) a combined port. The first and second RF band ports of the combiner 20 are coupled to corresponding outputs on phase shifters 16, 18. For example, the first RF band port of a first combiner 20 is coupled to the first output of first RF band phase shifter 16 and the second RF band port of the first combiner 20 is coupled to the first output of second RF band phase shifter 18. In this example, the first RF band port of each combiner 20 is configured to pass signals corresponding to the first RF band, and the second RF band port of each combiner 20 is configured to pass signals corresponding to the second RF band. The combined port of each combiner 20 is coupled to a cable termination 22. The combined port is configured to pass both the first RF band and the second RF band.

The multi-band electrical tilt circuit board 10, including the phase shifters 16, 18 and combiners 20, may be implemented in a common medium. The common medium may comprise a printed circuit board, an air suspended stripline construction, or other suitable medium. In another example, the phase shifters 16, 18 may be implemented on a common medium and the combiners 20 may be fabricated separately and mounted on the common medium. For example, the combiners may be implemented as a microstrip-fed cavity filter that is soldered onto a PCB including phase shifters 16, 18.

While the multi-band electric tilt circuit board 10 of FIG. 1 is illustrated as servicing two RF bands, one of ordinary skill in the art will recognize that this structure may be expanded to three or more RF bands. In such a case, the number of phase shifters, and the number of ports on the combiners, would increase with each additional band. Additionally, a multi-band electrical tilt circuit board 10 may be configured for high band or low band operation. In one example, involving low band frequencies, the first RF band may comprise 880-960 MHz and the second RF band may comprise 790-862 MHz. In another example involving high band frequencies, the first RF band may be 1710-1880 MHz and the second RF band may be 1920 MHz-2170 MHz. Alternatively with respect to this example, a third RF band at 2.5-2.7 GHz may be included. In another alternative embodiment, the first RF band may be 1710-2170 MHz and the second RF band may be 2.5-2.7 GHz. Additional combinations of bands are contemplated.

Figure 2:
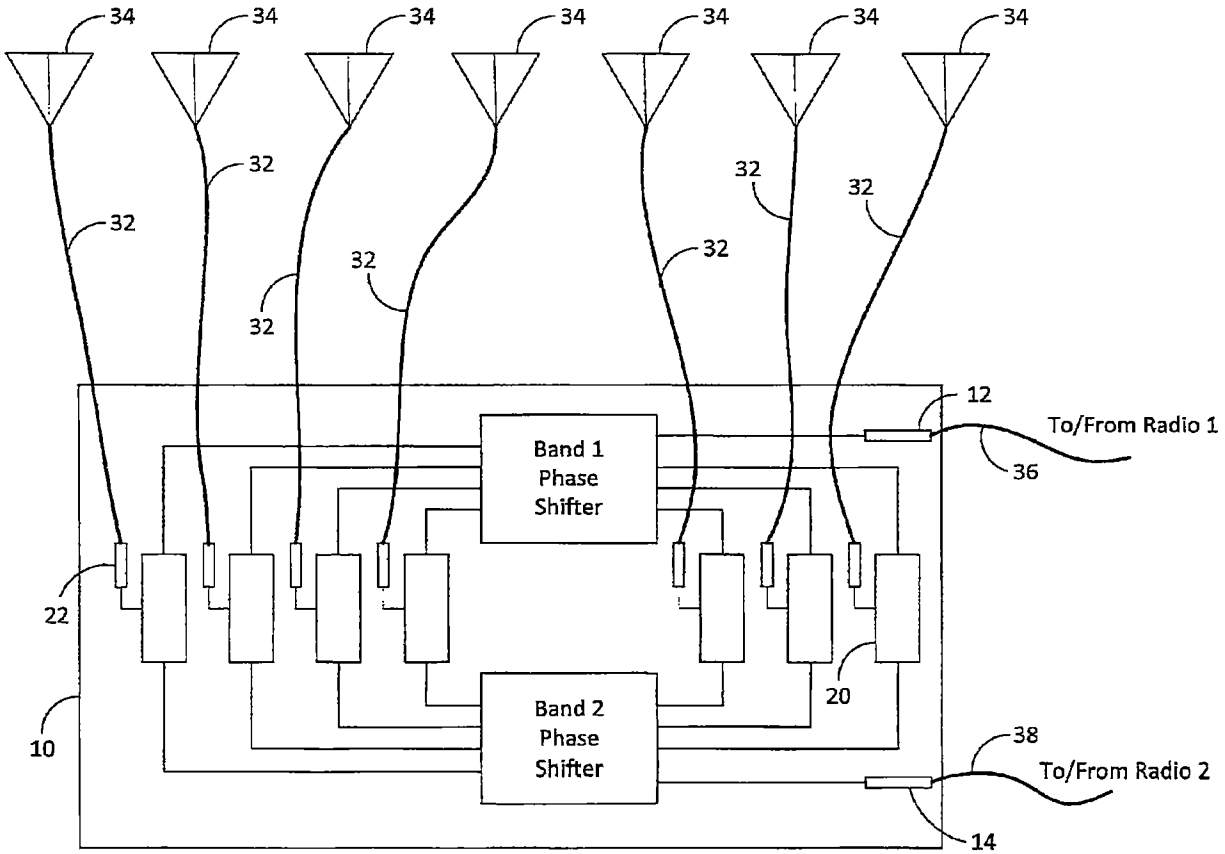
FIG. 2 is a schematic view of a dual band electric tilt circuit board in the context of an antenna system.

Referring to FIG. 2, the schematic illustration of a multi-band electrical tilt circuit board 10 from FIG. 1 is illustrated with coaxial connections to other components. Each antenna element 34 is coupled to a combiner 20 by way of a coaxial transmission line 32 and a cable termination 22. In some embodiments, each radiating element may be associated with a circuit board or boards for terminating coaxial transmission line 36 and for providing a balun for converting RF signals from unbalanced to balanced and back. The transmission line termination 12 terminates coaxial transmission line 36 from a radio operating in the first RF band, and transmission line termination 14 terminates coaxial transmission line 38 from a radio operating in the second RF band.

Figure 3:
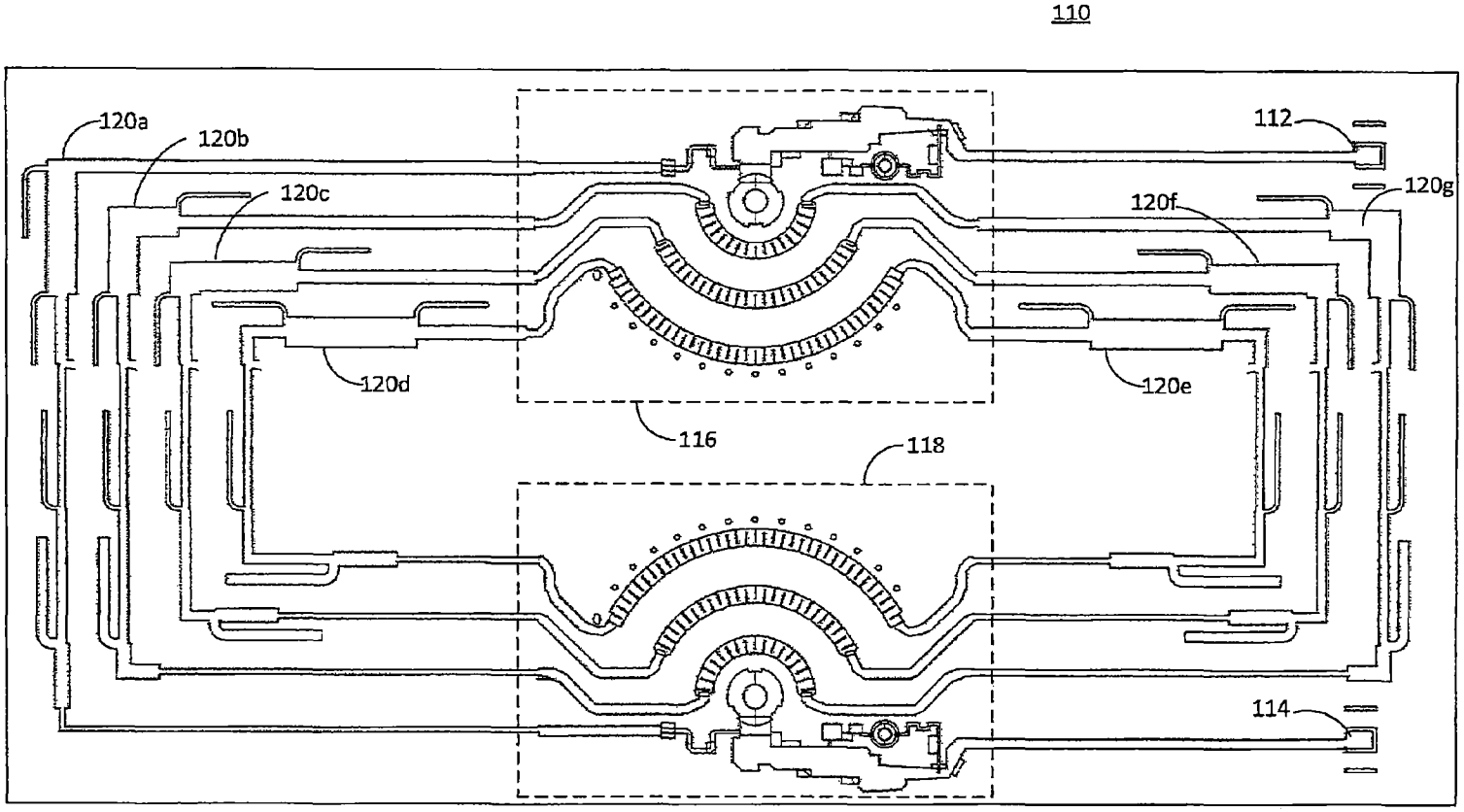
FIG. 3 is one example of a printed circuit board layout for a dual band electric tilt circuit board according to the present invention.

Referring to FIG. 3, one example of a physical implementation of a multi-band electrical tilt circuit board 110 is illustrated. In this example, a fixed portion of a first band phase shifter 116, a second band phase shifter 118 and the diplexers 120*a*-120*g* are implemented using printed circuit board (PCB) fabrication techniques. Also illustrated are coaxial terminations 112 and 114. Rotatable wiper arms for the phase shifters 116, 118 are not illustrated to enhance clarity of the fixed portions of the phase shifters 116, 118. Most preferably, the fixed portion of the phase shifters 116, 118 and the diplexers 120*a*-120*g* are fabricated on a common PCB with microstrip transmission lines providing the connections between the components. This allows for a significant reduction in cables required.

Figure 4:
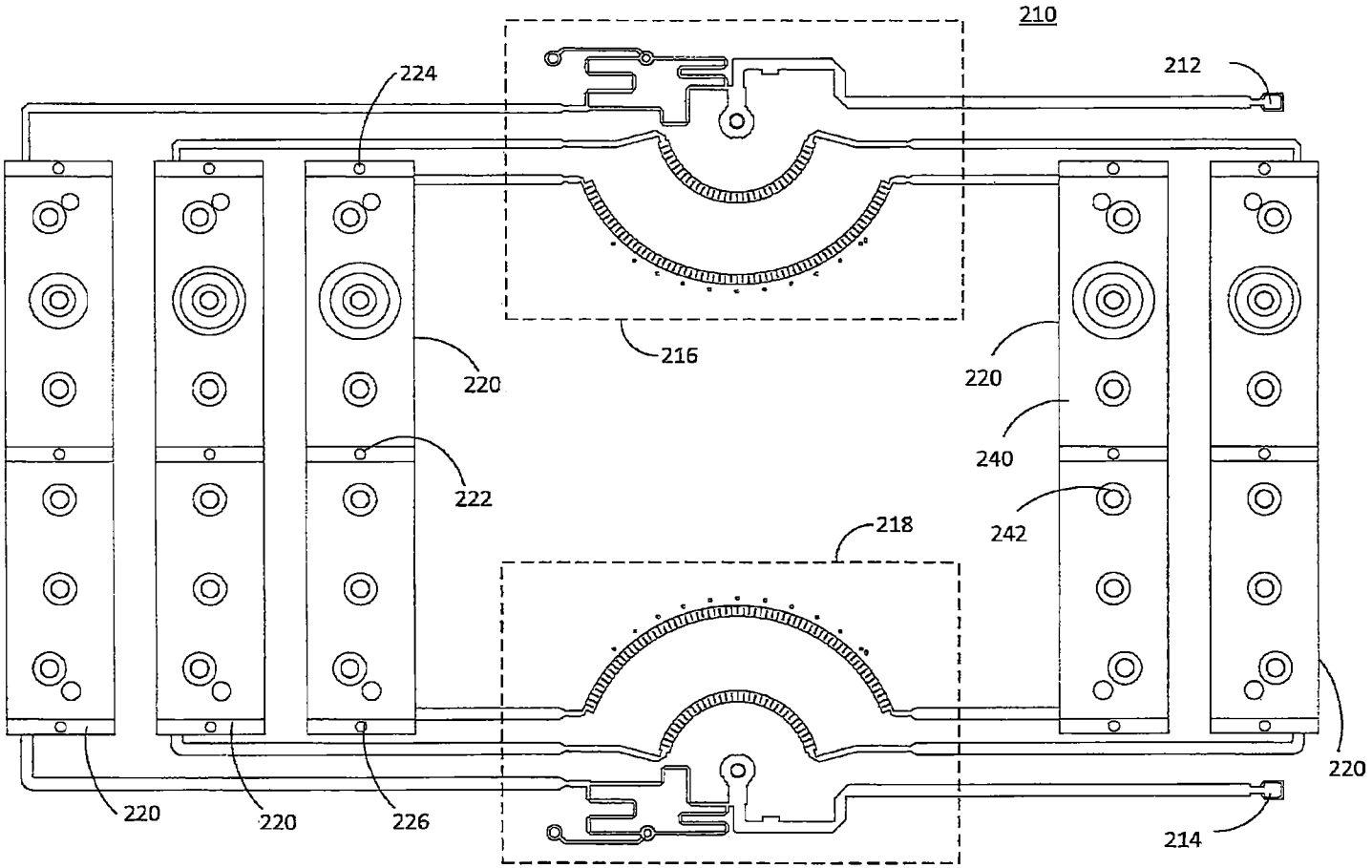
FIG. 4 is a second example of a printed circuit board layout according to the present invention including a plurality of diplexers mounted directly on the circuit board.
Figure 5:
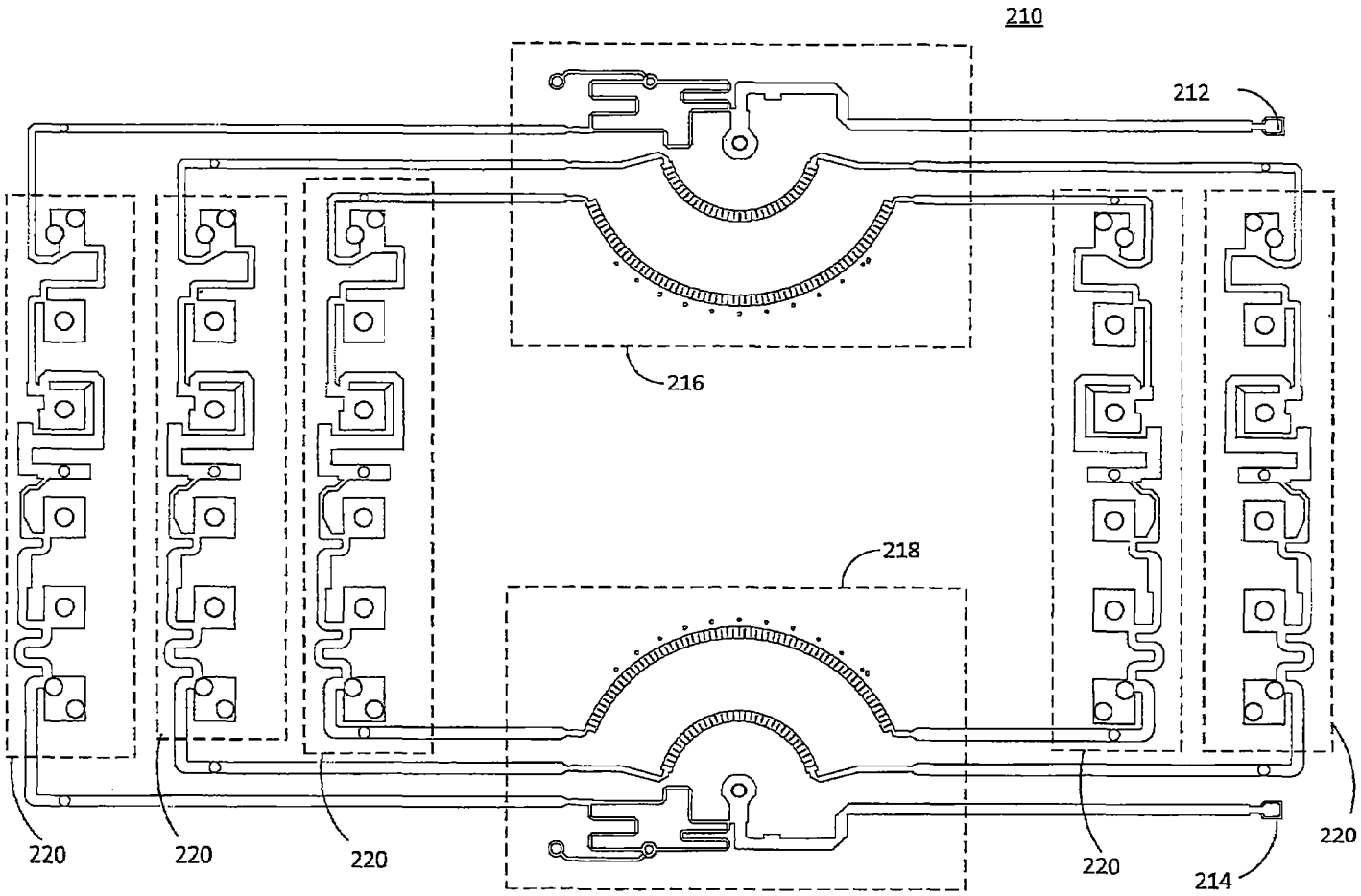
FIG. 5 is another view of the example of FIG. 4, with cavity housings removed to reveal more detail.

Referring to FIGS. 4 and 5, a second example of a physical implementation of a multi-band electrical tilt circuit board 210 is illustrated. In this example, each of a plurality of diplexers 220 are implemented as a microstrip-fed cavity filter including a cavity housing 240. The microstrip portion of the diplexer 220 may be fabricated on the same PCB as a fixed portion of a first band phase shifter 216 and a second band phase shifter 218. In another example, the diplexers 220 are separately fabricated PCB and cavity housing combinations, and are soldered directly to a PCB including first band phase shifter 216 and second band phase shifter 218.

The diplexers may comprise two series notch filters (see, e.g., FIGS. 5 and 6) with a common port 222 in the middle, a first band input 224 at one end, and a second band input 226 at the other end. The cavity housing 240 may be machined to provide a cavity enclosing each notch filter of the diplexer 220. Tuning plugs 242 may also be included to further tune the frequency response of the notch filters. FIG. 5 illustrates the multi-band electrical tilt circuit board 210 with the cavity housings 240 removed.

Figure 6:
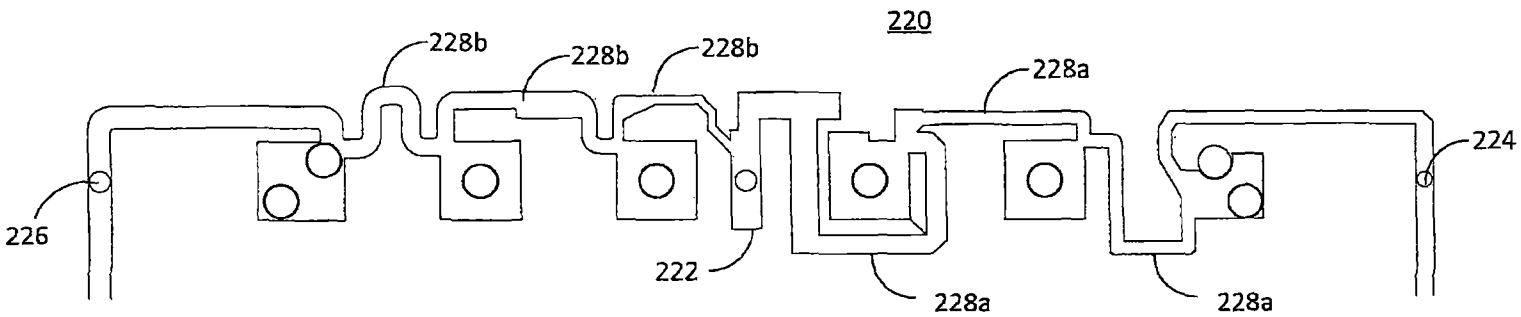
FIG. 6 is a detailed view of a diplexer that may be used in the printed circuit board layout of FIGS. 4 and 5.

Referring to FIG. 6, one of the diplexers 220 of FIG. 5 is illustrated in detail. The diplexers 220 each have a common port 222 first band input 224, and a second band input 226. The illustrated example contains three notch filters 228*a* between the first band input 224 and the common port 222, and three notch filters 228*b* between the second band input 226 and the common port 222. The notch filters 228*a*, 228*b*, are configured to pass the first and second bands, respectively, and block other frequencies. Alternatively, the diplexers may use a number of resonant stubs that act as stop-band filters, blocking energy in specific bands. The resonant frequency most heavily depends on the length of the stub and how the stub is terminated. For example an open-circuited stub will block frequencies such that the stub is a quarter-wavelength long while a short-circuited stub will block frequencies such that the stub is a half-wavelength long. The impedance of the stub also impacts its performance and in many cases performance either in terms of amount of rejection in dB or bandwidth in frequency are improved by dividing the stub into subsections each with its own separate impedance.

Also illustrated in FIGS. 4 and 5 are coaxial terminations 212 and 214. Rotatable wiper arms for the phase shifters 216, 218 are not illustrated to enhance clarity of the fixed portions of the phase shifters 216, 218. Preferably, the fixed portion of the phase shifters 216, 218 and the diplexers 220 are fabricated on a common PCB with microstrip transmission lines providing the connections between the components. This allows for a significant reduction in cables required.

The structure of the present invention permits independent adjustment of downtilt for each band. Additionally, the present invention reduces weight and cabling complexity relative to prior-known solutions.

While the invention has been described above by reference to various embodiments, it should be understood that many changes and modifications can be made without departing from the scope of the invention. It is therefore intended that the foregoing detailed description be regarded as illustrative rather than limiting, and that it be understood that it is the following claims, including all equivalents, that are intended to define the spirit and scope of this invention.

That which is claimed is:

1. A multi-band antenna system, comprising:

an array of wide-band radiating elements;

a multi-band electrical tilt circuit, comprising:

a plurality of combiners, each combiner having a combined port, a first radio frequency ("RF") band port, and a second RF band port, each combined port being coupled to the array of wide-band radiating elements;

a first RF band variable phase shifter having a first input and a first plurality of outputs that are connected to respective ones of the first RF band ports via respective ones of a first plurality of transmission lines; and a second RF band variable phase shifter having a second input and a second plurality of outputs that are connected to respective ones of the second RF band ports via respective ones of a second plurality of transmission lines, wherein a portion of the first RF band variable phase shifter and a portion of the second RF band variable phase shifter are mounted in a common medium, wherein the first RF band variable phase shifter is independently configurable from the second RF band variable phase shifter, and wherein the first and second RF band variable phase shifters are positioned adjacent each other with a first subset of the combiners arranged on a first side of the first RF band phase shifter and on a first side of the second RF band variable phase shifter and a second subset of the combiners arranged on a second side of the first RF band phase shifter and on a second side of the second RF band variable phase shifter, the second side of the first RF band phase shifter being opposite the first side of the first RF band phase shifter, and the second side of the second RF band phase shifter being opposite the first side of the second RF band phase shifter.

2. The multi-band antenna system of claim 1, wherein a first RF band port of each combiner in the first subset is adjacent the first side of the first RF band variable phase shifter and a second RF band port of each combiner in the first subset is adjacent the first side of the second RF band variable phase shifter.

3. The multi-band antenna system of claim 2, wherein a first RF band port of each combiner in the second subset is adjacent the second side of the first RF band variable phase shifter and a second RF band port of each combiner in the second subset is adjacent the second side of the second RF band variable phase shifter.

4. The multi-band antenna system of claim 1, wherein each combiner comprises a diplexer filter.

5. The multi-band antenna system of claim 1, wherein each combiner comprises a notch filter.

6. The multi-band antenna system of claim 1, wherein each combiner comprises a stop-band filter.

7. The multi-band antenna system of claim 6, wherein each stop-band filter comprises at least one resonant stub.

8. The multi-band antenna system of claim 1, wherein the array of wide-band radiating elements comprises dual-polarized wide-band radiating elements, wherein the multi-band electrical tilt circuit comprises a first polarization multi-band electrical tilt circuit that is coupled to first polarization elements of the dual-polarized wide-band radiating elements, and wherein the multi-band antenna system further comprises a second polarization multi-band electrical tilt circuit that is coupled to second polarization elements of the dual-polarized wide-band radiating elements.

9. The multi-band antenna system of claim 1, wherein each combiner is implemented using stepped impedance microstrip on printed circuit board.

10. A multi-band antenna system, comprising:

an array of wide-band radiating elements;

a multi-band electrical tilt circuit, comprising:

a plurality of microstrip-fed cavity diplexer filters implemented on a common printed circuit board, each microstrip-fed cavity diplexer filter having a combined port, a first radio frequency ("RF") band port, and a second RF band port, each combined port being coupled to the array of wide-band radiating elements;

a first RF band variable phase shifter having a first input and a first plurality of outputs that are connected to respective ones of the first RF band ports via respective ones of a first plurality of transmission lines; and a second RF band variable phase shifter having a second input and a second plurality of outputs that are connected to respective ones of the second RF band ports via respective ones of a second plurality of transmission lines, wherein the first RF band variable phase shifter is independently configurable from the second RF band variable phase shifter.

11. The multi-band antenna system of claim 10, wherein each microstrip-fed cavity diplexer filter includes a cavity housing.

12. The multi-band antenna system of claim 11, wherein each microstrip-fed cavity diplexer filter includes at least two series notch filters.

13. The multi-band antenna system of claim 12, wherein each microstrip-fed cavity diplexer filter further includes tuning plugs.

14. The multi-band antenna system of claim 13, wherein each microstrip-fed cavity diplexer filter includes at least three notch filters in series between the first RF band port and the combined port.

15. The multi-band antenna system of claim 14, wherein each microstrip-fed cavity diplexer filter includes at least three notch filters in series between the second RF band port and the combined port.

16. The multi-band antenna system of claim 10, wherein each microstrip-fed cavity diplexer filter comprises a stop-band filter.

17. The multi-band antenna system of claim 16, wherein each stop-band filter comprises at least one resonant stub.

18. The multi-band antenna system of claim 10, wherein the first and second RF band variable phase shifters are positioned adjacent each other with a first subset of the microstrip-fed cavity diplexer filters arranged on a first side of the first RF band phase shifter and on a first side of the second RF band variable phase shifter and a second subset of the microstrip-fed cavity diplexer filters arranged on a second side of the first RF band phase shifter and on a second side of the second RF band variable phase shifter, the second side of the first RF band phase shifter being opposite the first side of the first RF band phase shifter, and the second side of the second RF band phase shifter being opposite the first side of the second RF band phase shifter.

19. The multi-band antenna system of claim 18, wherein a first RF band port of each microstrip-fed cavity diplexer filter in the first subset is adjacent the first side of the first RF band variable phase shifter and a second RF band port of each microstrip-fed cavity diplexer filter in the first subset is adjacent the first side of the second RF band variable phase shifter.

20. The multi-band antenna system of claim 10, wherein the array of wide-band radiating elements comprises dual-polarized wide-band radiating elements, wherein the multi-band electrical tilt circuit comprises a first polarization multi-band electrical tilt circuit that is coupled to first polarization elements of the dual-polarized wide-band radiating elements, and wherein the multi-band antenna system further comprises a second polarization multi-band electrical tilt circuit that is coupled to second polarization elements of the dual-polarized wide-band radiating elements.

* * * * *